United States Patent [19]

Holderer et al.

[11] 4,379,353

[45] Apr. 12, 1983

[54] CONTINUOUS METHOD FOR BLEACHING WITH PEROXIDE

[75] Inventors: Horst Holderer, Krefeld; Johannes Kutz, Tönisvorst, both of Fed. Rep. of Germany

[73] Assignee: Eduard Küsters, Krefeld, Fed. Rep. of Germany

[21] Appl. No.: 210,301

[22] Filed: Nov. 25, 1980

[30] Foreign Application Priority Data

Mar. 15, 1980 [DE] Fed. Rep. of Germany ..... 3010139

[51] Int. Cl.[3] ..... D06L 3/16

[52] U.S. Cl. ..... 8/149.1; 8/111; 8/149.3; 8/152

[58] Field of Search ..... 8/111, 149.1, 149.3, 8/152; 68/5 D, 5 E

[56] References Cited

U.S. PATENT DOCUMENTS

| | | | |
|---|---|---|---|
| 2,522,900 | 9/1950 | Schmitt | 68/5 D X |
| 3,353,903 | 11/1967 | Potter et al. | 8/111 |
| 3,370,911 | 2/1968 | Westall | 8/111 |
| 3,481,684 | 12/1969 | Sando et al. | 8/111 |

FOREIGN PATENT DOCUMENTS

| | | | |
|---|---|---|---|
| 1444012 | 2/1963 | Fed. Rep. of Germany . | |
| 2502998 | 7/1976 | Fed. Rep. of Germany | 8/111 |

*Primary Examiner*—Philip R. Coe

*Attorney, Agent, or Firm*—Kenyon & Kenyon

[57] ABSTRACT

A continuous method for bleaching goods containing cotton with peroxide in which a web of material is left standing in a bleaching bath in folded condition at a temperature of 60±10° and is subsequently steamed, with the material under tension, at a temperature in the vicinity of 100° C.

6 Claims, No Drawings

CONTINUOUS METHOD FOR BLEACHING WITH PEROXIDE

BACKGROUND OF THE INVENTION

This invention relates to the bleaching of materials containing cotton in general and more particularly to an improved method for the continuous bleaching of cotton containing materials with peroxide.

Cold bleaching methods, in which the goods are impregnated with hydrogen peroxide and are left lying for about 24 hours are known. There are also cold bleaching methods in which the storage time is only 12 to 16 hours, but is followed by steaming for a short time in order to activate the unspent peroxide still present in the material. Hot bleaching methods, in which the goods are impregnated while hot, i.e. at 80° to 100° C. and are then wound on a spool contained in a thermal reaction chamber and are left there for several hours, have also been used. None of these methods are continuous. In continuous hot bleaching methods using hydrogen peroxide, bleaching times in the order of 15 to 45 minutes are presently required.

Since such times cannot be realized in a continuous process with the material being transported under tension if sufficient operating speed is to be provided, and the apparatus is not to be too large, the continuous bleaching treatment is carried out with the material deposited in folds, be it in J-boxes, on horizontal holding belts or pleated in stacks. Full white and print material can be processed while deposited in folds because in these goods there are no large uniformly dyed areas. Uniformly or substantially uniformly dyed material, however, unless it is of specially light quality, can be processed only if the material runs without folds, when in the bleaching stage, since the folds formed during the bleaching are distinctly noticeable in the subsequent dyeing. Problems are encountered in this respect particularly with expensive material which is used for outer wear, for instance, cotton material, material of polyester/cotton or also polyamide/cotton.

Heretofore, only batch processes have been customary for these goods if they were to be dyed uniformly, with the web of material wound up, i.e., stored without folds, during the dwelling time, or, through the use of so-called short time bleaching processes, in which the dwelling time is replaced by the use of appropriate chemicals. These processes are accompanied by very large consumption of chemicals. With these short time processes, operation can be continuous, of course.

It is a disadvantage of the short time processes, in turn, that the shells of the cotton cannot be removed thoroughly. Up until this time, this difficulty has been overcome only by using one of the processes with a long dwelling time.

DESCRIPTION OF THE INVENTION

It is an object of the present invention to provide a method for bleaching materials containing cotton using peroxide, of the type in which the material is left standing in a peroxide bath and then steamed, in such a manner that, with uniform dyeing, neither traces of folds are noticeable, nor do shells remain in the material.

The solution of this problem according to the present invention is to treat the material in standing condition in folded condition at a temperature of 60±10° C. and to carry out the steaming with the material under tension and at a temperature of about 100° C.

The swelling of cotton in a liquid alkaline medium at concentrations such as occur in scouring or bleaching, is at its minimum in the range of 60 degrees. Also, cotton fiber which is only slightly swelled has little sensitivity to folds. At this temperature, the material can therefore stand being run through the bleaching bath in folds without traces of folds which stand out in the dyeing reamining in the material after subsequent steaming.

The present invention therefore replaces cold impregnation with a hot impregnation in a temperature range, in which the folds that develop still are of such a nature that they disappear again in the subsequent steaming operation.

An important advantage of the method according to the present invention is the shortening of the dwelling times required.

The dwelling time in the bleaching bath is preferably 3 to 15 minutes; it has been shown by tests that with a two stage bleaching process, in which the main bleaching stage is preceded by a scouring stage, the dwelling time in the bleaching bath can be about 5 minutes, while the dwelling time in the bleaching bath in a single stage bleaching process may be about 10 minutes.

Dwelling times in the steamer of 1 to 4 minutes are recommended, and preferably about 2 minutes.

Thus, dwelling times, especially in the bleaching bath, which can be employed without difficulty for continuous operation in folded condition, in conventional reaction and retention apparatus while maintaining economical operating speeds are obtained.

One important practical embodiment of the method of the present invention, includes impregnating the web of material with the bleaching solution while cold. After passing heating zones at 60±10° C., the material is run into the main bleaching bath, which contains bleaching solution of the same concentration, and stays submerged therein under bleaching liquor.

The impregnation takes place in a tank, through which and out of which the web of material is run via a squeezing mechanism. The bleaching solution dragged along with the web of material is heated up, so that when entering the main bleaching bath, there are neither appreciable differences in concentration nor in temperature between the material and the liquor.

Bleaching under liquor is known per se. In the known manner of realization, however, the share of bleaching solution which is carried along is lost and is washed out. In the present invention, on the other hand, a substantial part of the bleaching process still takes place in the steamer following the main bleaching bath and is provided there by the amounts of chemicals still present in the material.

OPERATING EXAMPLES (A) Two-Stage Bleaching—Fabric of 100% cotton and of PES/cotton 50:50 was treated as follows:

Stage 1 (Scouring)

The following steps are carried out:

Impregnating with scouring liquor in a screen tank;

Standing in the scouring liquor in a reaction and retention equipment (temperature: 60° C.; dwelling time: 5 min.);

Steaming for 2 minutes at 100° C.;

Water seal at 70° C.;

Washing out at scouring temperature; and

Squeezing out.

Composition of the scouring liquor:

10 ml/l Clarogen AT 891

67 ml/l NaOH 38° Bé.

Stage 2 (Bleaching)

The following steps were carried out:

Impregnating with bleaching liquor in a screen tank (wet-in-wet);

Standing in the bleaching liquor in the reaction and retention equipment (Temperature: 60° C.; dwelling time: 5 min.);

Steaming for 2 minutes at 100° C.;

Water seal at 70° C.;

Washing out at boiling temperature;

Squeezing out; and

Drying.

Composition of the bleaching liquor:

10 ml/l Cottozon SK 855 (Stabilizer)

10 ml/l NaOH 38° Bé

35 ml/l $H_2O_2$ 35%

2 ml/l Budavon TR 870 (Wetting agent)

Water 7° dH. (°dH=German degree of water hardness)

(B) Single-Stage Bleaching 900 m fabric 100% cotton (Qual. 23199)

900 m fabric 100% cotton (Qual. 21355)

130 m fabric PES/cotton 50:50 (Qual. 24732) (all fabrics desized)

were treated as follows:

Impregnating with bleaching liquor (60° C.) in a screen tank (velocity, 15 m/min.);

Standing in the bleaching liquor in reaction and retention equipment (Temperature: 55° to 60° C.; dwelling time: 10 min.);

Steaming for 2 min. at 100° C.;

Water seal 70° C.;

Washing out at boiling temperature;

Squeezing out; and

Drying.

Composition of the bleaching liquor:

7 ml/l Cottozon SM 886 (Stabilizer)

20 ml/l NaOH 38° Bé

35 ml/l $H_2O_2$, 35%

5 ml/l Budavon TR 870 (Wetting agent)

Water 7° dH. (°dH=German degree of water hardness)

In all cases, a completely shell free material was obtained which showed no traces of folds of any kind in the subsequent dyeing.

What is claimed is:

1. In a continuous method for bleaching goods containing cotton with peroxide, wherein a web of material is left standing in a bleaching bath and is subsequently steamed, the improvement comprising carrying out the step of leaving the material standing by means of a retention in folded condition at a temperature of 60±10° C., and carrying out the steaming, with the material under tension, at a temperature in the vicinity of 100° C.

2. The method according to claim 1, wherein the standing time in the bleaching bath is about 3 to 15 minutes.

3. The method according to claim 2, wherein a two stage bleaching process is employed and the standing time in the bleaching bath is about 5 minutes.

4. The method according to claim 2, wherein a single stage bleaching process is used and the standing time in the bleaching bath is about 10 minutes.

5. The method according to one of the claims 1 to 4, wherein the steaming time is about 1 to 4 minutes and preferably, 2 minutes.

6. The method according to claim 5, wherein the web of material is impregnated with bleaching liquor cold, is run past heating zones and is run into a main bleaching bath which contains bleaching solution of the same concentration as the impregnating bleaching liquor at a temperature of 60±10° C.

* * * * *